United States Patent [19]

Ashelman, Jr. et al.

[11] Patent Number: 4,635,465

[45] Date of Patent: Jan. 13, 1987

[54] DIE PULLING APPARATUS

[75] Inventors: Robert U. Ashelman, Jr., Akron; Michael G. Townsend, Stow; Mark C. Lawrence, Cuyahoga Falls, all of Ohio

[73] Assignee: Karder Machine Co., Akron, Ohio

[21] Appl. No.: 793,638

[22] Filed: Oct. 31, 1985

[51] Int. Cl.[4] ..... B21D 37/16; B21J 9/02

[52] U.S. Cl. ..... 72/448; 72/446; 72/455; 100/224; 100/229 R

[58] Field of Search ..... 72/446, 447, 448, 46, 72/414, 455, 342; 100/224, 229 R, 918

[56] References Cited

U.S. PATENT DOCUMENTS

| | | | |
|---|---|---|---|
| 2,259,576 | 10/1941 | MacMillin . | |
| 2,975,701 | 3/1961 | Munschauer, Jr. et al. . | |
| 3,111,100 | 11/1963 | Georgeff | 72/455 |
| 3,422,660 | 1/1969 | Countess, Jr. et al. . | |
| 3,422,661 | 1/1969 | Blackhurst . | |
| 3,427,854 | 2/1969 | Michelson . | |
| 3,461,794 | 8/1969 | Schaeffer . | |
| 3,638,471 | 2/1972 | Martin . | |
| 3,673,849 | 7/1972 | Voltsekhovsky . | |
| 3,810,381 | 5/1974 | Roth . | |
| 3,831,427 | 8/1974 | Lee . | |
| 3,841,142 | 10/1974 | Aisuta et al. . | |
| 3,935,811 | 2/1976 | Lenz et al. . | |
| 3,969,921 | 7/1976 | Jonsson et al. | 72/455 |
| 3,986,448 | 10/1976 | Seyfried et al. . | |
| 4,044,592 | 8/1977 | Carrieri et al. . | |
| 4,206,699 | 6/1980 | Hemmelgarn . | |
| 4,301,673 | 11/1981 | Yonezawa et al. . | |
| 4,408,521 | 10/1983 | Schelli et al. . | |
| 4,424,742 | 1/1984 | Yamashita . | |
| 4,433,620 | 2/1984 | Kiyosawa . | |
| 4,444,039 | 4/1984 | Asari et al. . | |
| 4,510,789 | 4/1985 | Tomioka et al. . | |
| 4,517,649 | 5/1985 | Kitagawa . | |
| 4,519,309 | 5/1985 | Feirer et al. . | |

*Primary Examiner*—W. D. Bray

*Attorney, Agent, or Firm*—Oldham, Oldham & Weber Co.

[57] ABSTRACT

A die pulling apparatus comprising a pair of die puller box assemblies, means for lifting the die puller box assemblies from a lower position to a raised position in which the top surfaces of the die puller box assemblies are flush with the die supporting surface of a stationary die supporting member, such as a bolster, and means for moving the die horizontally from the die puller box assemblies to the stationary member or vice versa when the die puller box assemblies are in their raised position.

11 Claims, 6 Drawing Figures

DIE PULLING APPARATUS

TECHNICAL FIELD

This invention relates to a die pulling apparatus and more particularly to an apparatus for changing dies which are used in presses.

BACKGROUND ART

Dies which are used in presses for stamping metal parts must be replaced from time to time, because of die wear and because the same press will be used at different times to produce different parts. Die changes are relatively frequent at automobile stamping plants because of the number of different metal parts in an automobile. Die changes must be even more frequent at stamping plants which produce parts for more than one model of automobile. Replacement of a die results in lost time because the press must be shut down while a die is being changed. Additional concerns in replacing a die are safety and minimization of physical labor. The latter is a concern because most automobile parts are large, requiring large, heavy dies for their manufacture.

Up until now one way to remove a die from a press was to either push it out using a fork lift from the rear and bringing a crane from above to pull simultaneously while the fork lift is pushing from the rear, using some type of blocking or support to the front of the press on which to bring the die. Other ways of removing dies involve the use of a movable bolster on which the die is mounted. The die and the bolster are removed as a unit from the press and the die is taken off the bolster outside the press. For example, the bolster may be a rolling bolster which runs on tracks that go into the side of the press itself; the rolling bolsters are hydraulically activated, wheels drop down, the entire bolster itself rolls to the side of the press where a crane can pull it off and another die put in place back on the bolster. The bolster is then pushed back into the press, the wheels are raised and the bolster put back in place and bolted back down. U. S. Pat. Nos. 3,422,660 to Countess, Jr. et al and 3,986,448 to Sigfried et al illustrate such an arrangement.

Still another way for removing a die from a press is shown in U. S. Pat. No. 3,831,427 to Lee. According to this patent, a die and a die supporting shoe are moved as a unit from the press to a press feed table which is situated alongside the press. The table has two parallel horizontal table members and a single hydraulic or pneumatic actuator which is attached to the die shoe to move the same between the press and the feed table. While this apparatus is simpler than most arrangements which use moving bolsters, it still has certain disadvantages including a press feed table that is permanently in place, taking up space which might otherwise be used for manufacturing purposes.

Trying to pull a die out with chains and fork lifts takes too long, is too dangerous and is not cost efficient. The movable bolsters have too many moving parts which can wear. The wear factor on the wheels (where used) and on the tracks is extensive and the wheels are extremely expensive to replace.

DISCLOSURE OF THE INVENTION

According to this invention there is provided an apparatus for changing a die which is supported on stationary die supporting member when in use, said apparatus comprising (a) die puller means located alongside the stationary die supporting member, said die puller means having a first position in which it is operatively positioned for transfer of a die to or from said stationary die supporting member and a second position in which it is inoperative, said die puller means and said stationary die supporting member having die supporting surfaces which are substantially flush when said die puller means is in its first position; (b) means associated with said die puller means for moving a die horizontally from said die puller means to said stationary die supporting member or vice versa when said die puller means is in its first position; and (c) means for moving said die puller means between said first position and said second position. The stationary member may be a conventional press.

BEST MODE FOR CARRYING OUT THE INVENTION

Figure 1:
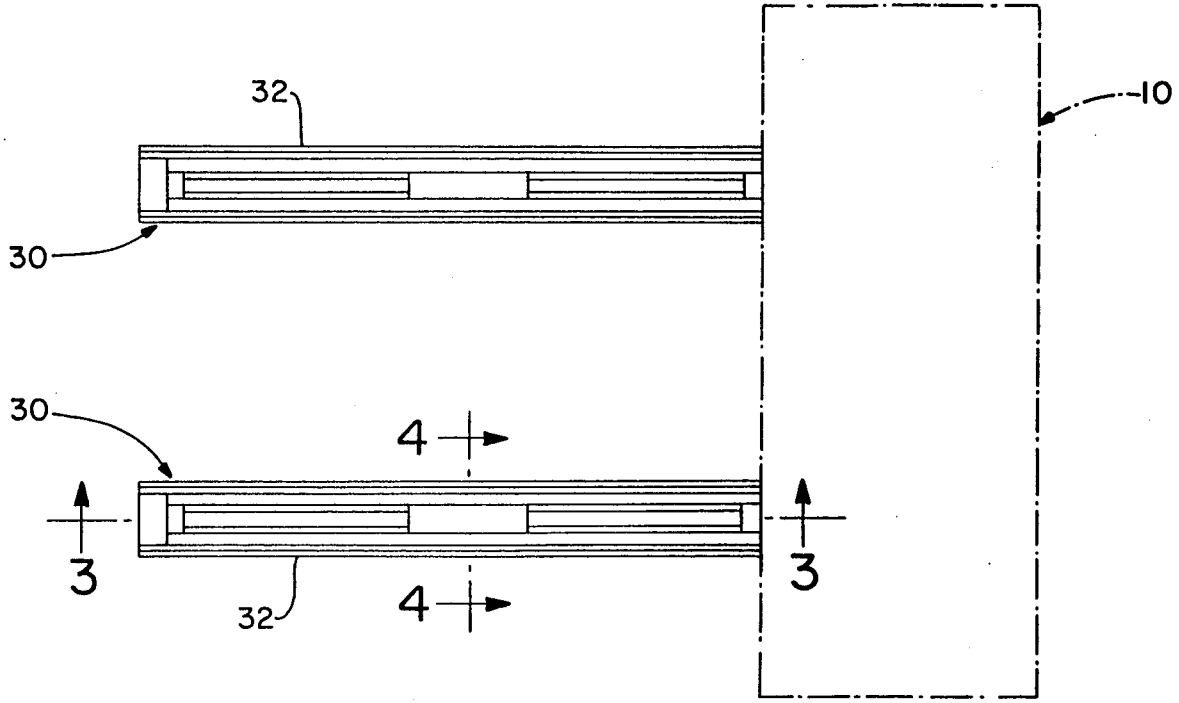
FIG. 1 is a plan view of the apparatus according to this invention and a press which is alongside the die puller apparatus, the press being shown in phantom lines.
Figure 2:
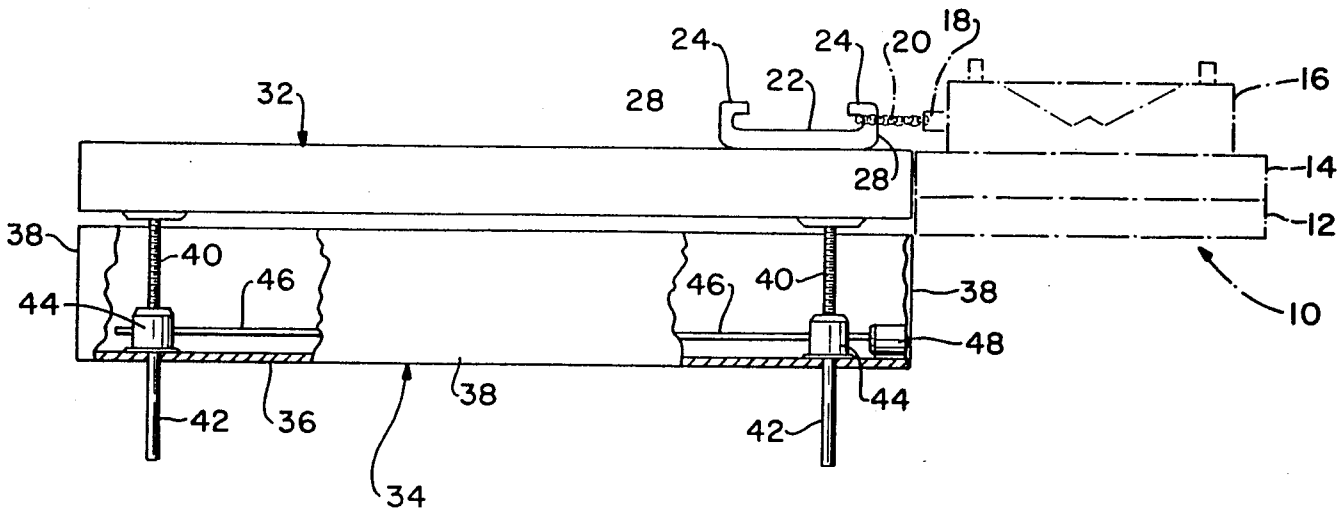
FIG. 2 is a front elevational view, with parts broken away and parts shown in cross-section, of the die puller apparatus of the present invention.
Figure 3:
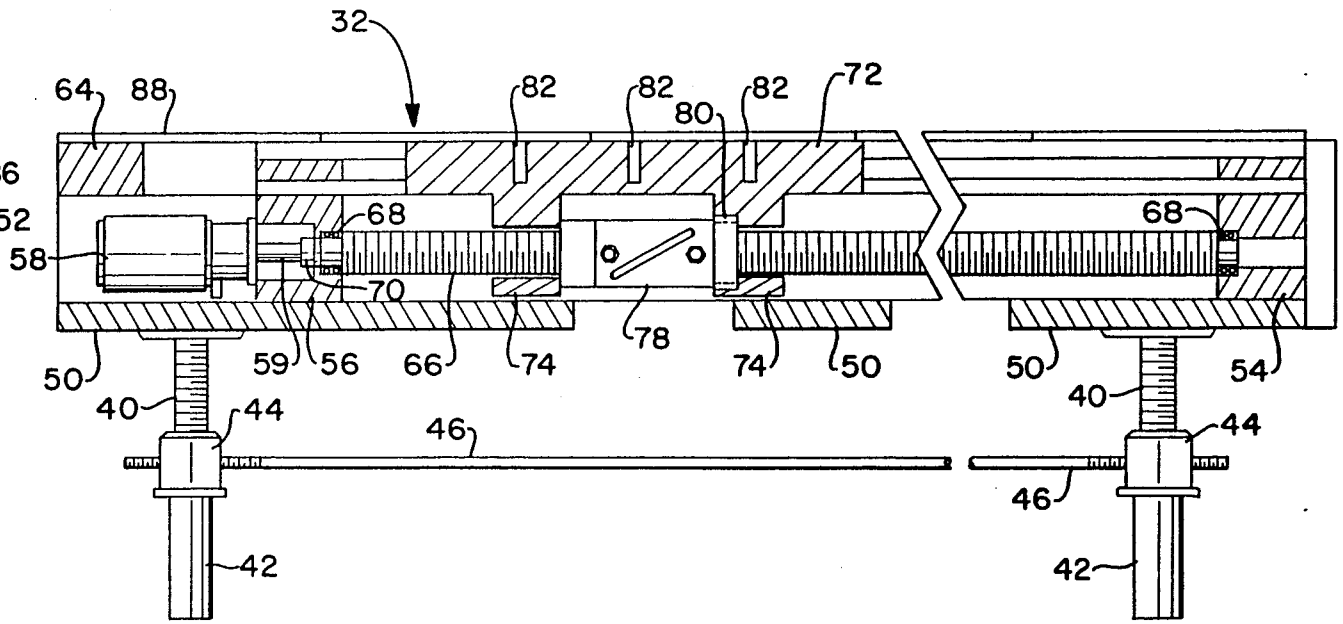
FIG. 3 is a vertical sectional view taken along line 3—3 of FIG. 1.
Figure 4:
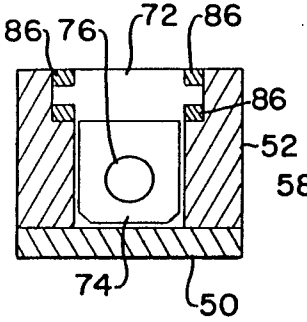
FIG. 4 is a vertical sectional view taken along line 4—4 of FIG. 1.
Figure 5:
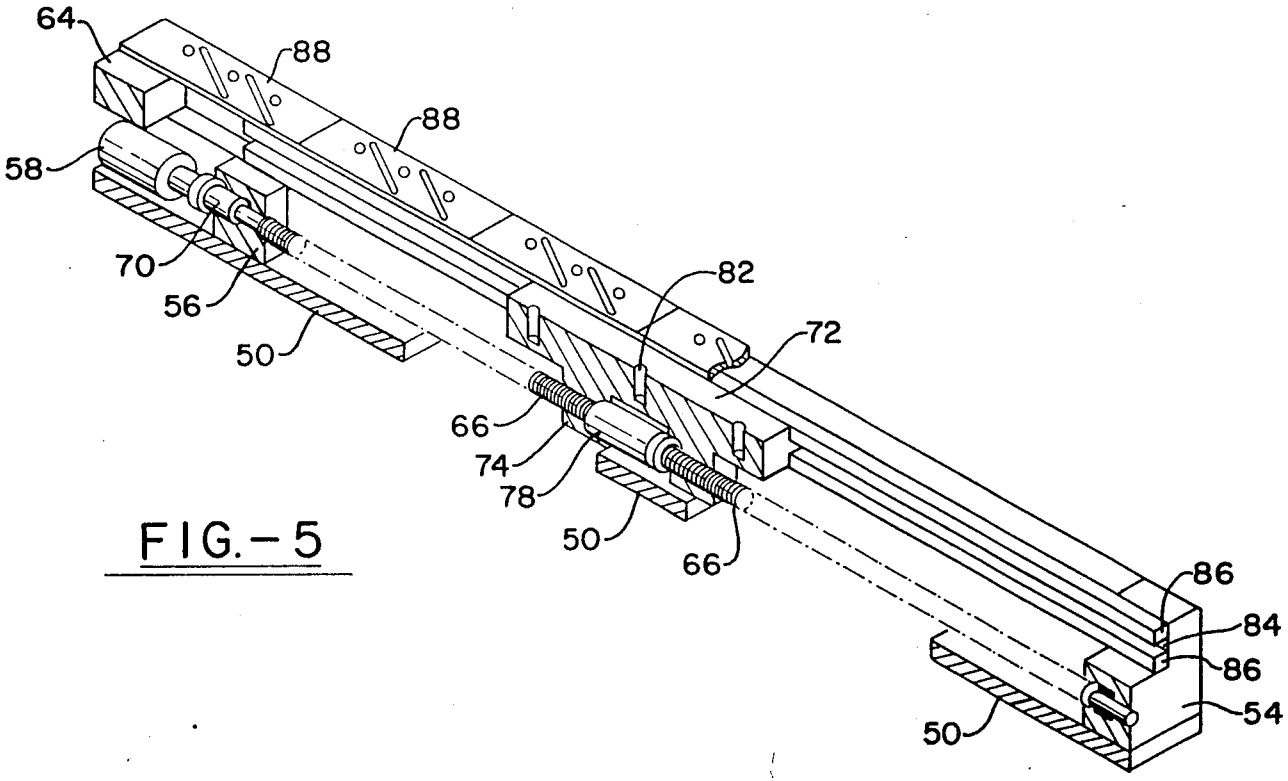
FIG. 5 is an isometric sectional view of the die puller assembly according to this invention, sectioned along the vertical plane represented by line 3—3 in FIG. 1.
Figure 6:
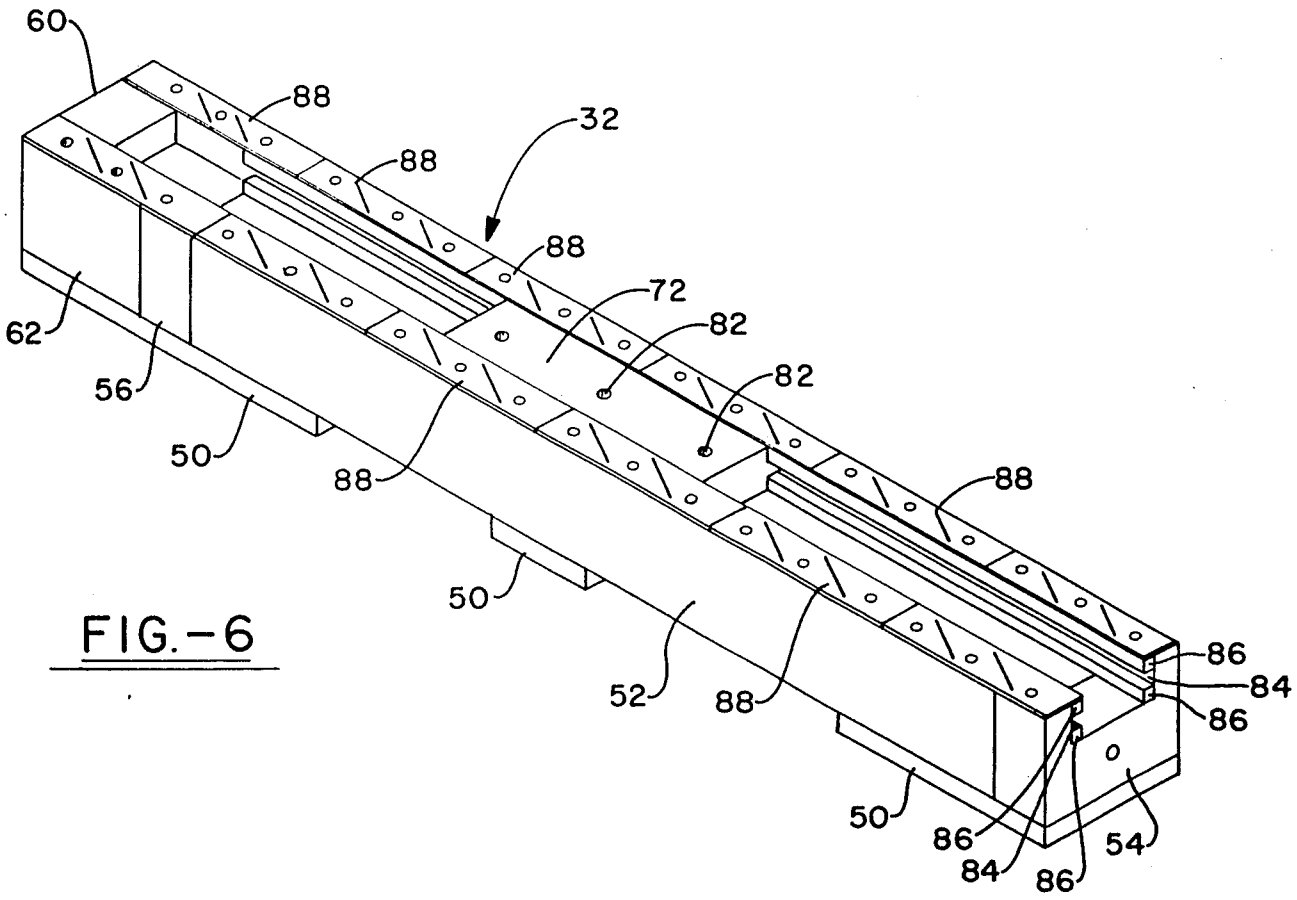
FIG. 6 is an isometric view of the die puller assembly according to this invention.

Turning now to FIGS. 1 and 2, 10 indicates generally a press, which may be conventional. Press 10 may include, for example, a press bed 12 and a bolster 14 which is above press bed 12 and bolted thereto. The bolster has suitable means, as for example a plurality of longitudinally extending T-slots for supporting a die 16 thereon. Die 16 may have a pair of hooks or eyelets 18 for attachment of a pair of chains 20 for pulling the die. Chains 20, in turn, may be attached to a pair of reciprocating die puller ram hooks 22. The ends 24 of hooks 22 are semicircular in shape to receive a chain 20, and each end has a flat portion 28 which provides a surface for pushing a die onto a bolster 14.

Located alongside press 10 are die puller means 30, which consist of a pair of die puller box assemblies 32. One end of each die puller box assembly 32 is adjacent to press 10. Each die puller box assembly 32 has one of the two reciprocating hooks 22 mounted thereon. The die puller box assemblies 32 support die 16 as it is being removed from press 10. An overhead crane, not shown, is provided for removing the die 16 from the die puller means 30 and for bringing a new die into place.

The two die puller box assemblies 32 may be spaced apart by any convenient distance. For example, the die puller box assemblies 32 may be about 4 feet apart (measured center to center) in an automobile stamping plant.

FIG. 2 shows die puller box assemblies 32 in a first position in which the assemblies are parallel, and in which the top surfaces of the assemblies are flush with the top surface of the press 10 or other stationary member on which the die 16 is normally supported for stamping operations. An important feature of the present invention is that it provides means for moving the die puller means 30 from a first position, as shown in FIG. 2, in which the die puller assemblies 32 are operatively positioned for transfer of a die 16 to or from press 10, to a second position in which the die puller means 30 is inoperative. When the die puller box 30 is in its first operative position, it is desirable to provide a key (not shown) for preventing the die puller box assemblies 32 from moving from side to side. This key may be conventional.

Each die puller box assembly 32 is movable from its first position, as shown in FIG. 2, to a second position in which it is not possible to move a die from the stationary member 10 to the die puller means 30 or vice versa. Preferably die puller box assemblies 32 are simply lowered from their first or raised position as shown in FIG. 2 to a second or lowered position.

Die puller box assemblies 32 when in their second or lowered position fit inside shrouds 34, which are normally installed below floor level. Typically the top of shrouds 34 and the base of press bed 12 are at floor level. Shrouds 34 are rectangular in shape and comprise a horizontal steel bottom surface 36 and vertical side and end walls 38. There are two shrouds 34, one for each die puller box assembly 32. At the top of each shroud 34 are a pair of swinging doors (not shown) which are flush with level of the plant floor in their closed position. These doors are lowered to the closed position when the die puller box assemblies 32 have been lowered into their respective shrouds 34.

Shrouds 34 house the mechanism for raising and lowering the die puller box assemblies 32. Each die puller box assembly 32 is raised and lowered by means of a pair of vertical jack screws 40. A pair of cylindrical metal sheaths 42 are provided to receive jack screws 40 when the die puller box assemblies 32 are in their second or lowered position or in an intermediate position between their first and second positions. Jack screws 40 are bolted to the bottom plate 36 of shroud 34 and to the bottom of the die puller assemblies 32. The jack screws 40 extend through worm gear boxes 44, which house conventional worm gear mechanisms for raising and lowering the jack screws 40 and the die puller box assemblies 32. A horizontal shaft 46 drives each of the worm gear mechanisms; shaft 46 in turn is driven by a hydraulic motor 48.

Shrouds 34 may be supported on steel girders (not shown).

The size of the die puller box assemblies 32 and the diameter and strength of the jack screws 40 is determined in accordance with the size and the weight of the dies 16.

The die puller assemblies 32 will now be described in detail with reference to FIGS. 3–6. The two die puller assemblies 32 are identical.

Each die puller box assembly 32 comprises a plurality of coplanar bottom plates 50. As shown, there are 3 bottom plates 50, one at each end and one in the middle, with space between adjacent plates. This arrangement makes possible a lighter weight die puller box assembly 32; it also decreases the cost of making the assembly and permits foreign material which enters the die puller box assembly 32 to drop out the bottom instead of being retained. Each die puller box assembly 32 also has a pair of side walls 52. Bottom plates 50 are welded to the side walls 52. Front and rear end plates, 54 and 56, respectively are secured to side walls 52. Front end plate 54 is at the end of assembly 32 which is closest to press 10, and rear end plate 56 is near the end which is remote from press 10. It will be noted that rear end plate 56 is not at the very end of the die puller box assembly 32. Instead, the rearmost bottom plate 50 extends beyond rear end plate 56 in order to protect hydraulic motor 58. Hydraulic motor 58 has a shaft 59 which extends externally of the motor housing toward press 10. Hydraulic motor 58 is surrounded by a motor box 60 which comprises a portion of the rearmost plate 50, a pair of side walls 62, and a horizontal protective top plate 64 which extends transversely between the top portions of side walls 62. It will be noted that the end of the motor box 60 is open to permit access to hydraulic motor 58 and the drive mechanism which is driven by this motor.

Motor 58 drives a ball screw 66, which is supported at its ends by front and rear end plates 54 and 56, respectively. Bearing assemblies 68 are provided for this purpose. Motor 58 drives ball screw 66 through a coupling 70.

Ball screw 66 drives a ram 72, which reciprocates between the front end plate 54 and the rear end plate 56. Depending from the underside of ram 72 are a pair of square brackets 74, each of which has a hole 76 to permit ball screw 66 to extend therethrough. The purpose of brackets 74 is to support ball screw nut 78. Ball screw nut 78 is held in place by a lock nut 80 at the forward end thereof. A recess in the forward bracket 74 is provided to receive lock nut 80.

A plurality of holes 82 (3 are shown) extend vertically through ram 72. These holes receive bolts (not shown) which bolt hook 22 to ram 72. In this manner reciprocation of the ram 72 causes hook 22 to reciprocate, so as to pull die 16 from press 10 to the die puller assemblies 32 or to push the die from the die puller assemblies 32 to the press 10.

Ram 72 reciprocates in a track way 84 which is formed by four brass gibs 86. Ram 72 is made of steel. Gibs 86 are bolted to the side frame members 52 by means of bolts (not shown) which extend from the outside of side frames 52 to the gibs 86. This arrangement permits quick replacement of gibs 86, which wear during normal operation and must be replaced at more frequent intervals than the remaining elements of the apparatus.

A plurality of top plates 88 are provided along each of the side frame members 52. The top surfaces of top plates 88 are slightly higher than the top surface of ram 72, so that the weight of the die 16 will be borne by the top plates rather than by ram 72 when die 16 is positioned on the die puller box 30. Top plates 88 also protect side rails 52 from wear. Plates 88 are made of a hard material, such as case hardened 1020 steel. These plates are replaced as they wear. The top surfaces of top plates 88 are flush with the top surface of bolster 14 when die puller box assemblies 32 are in their first or uppermost position.

The two die puller box assemblies 32 can be controlled independently of each other. Separate controls are provided for each of the two jack screw motors 48; likewise, separate controls are provided for each of the two hydraulic motors 58 which turn the respective ball screws 66.

By controlling the lifting and lowering of each assembly 32 separately, it is much easier to keep the two assemblies 32 at precisely the same level than would be the case if they were run by a common control mechanism. This is because some maladjustment in the hydraulic control mechanism is bound to occur, despite all attempts to keep the hydraulic system fine tuned.

In some situations it is necessary, or at least desirable, for the ends 72 of the respective assemblies 32 to be positioned at different distances from the press 10. This is principally because some dies are asymmetrical.

Separate controls enable one ram to be positioned closer to the die than the second ram. The advantage to this is that the die setter chains or straps 20 may be of different lengths, the difference in length of the straps or the difference in length of the distance of the hooks that are on the die may be different distances from the front of the die. The rams can be adjusted so that the chains are tight and when both rams are activated simultaneously the die is pulled out in one motion with no corners being ahead of the other. A second advantage of separate controls on the horizontal rams is mainly for ease in putting a die back into the press. When the crane drops or lowers the die on to the top plates 88 of the two parallel die assemblies 32, the rams are positioned so that each one can move the die into the press in one even motion. If one corner of the die gets ahead of the other, either ram can be advanced or backed off so that the corners of the dies become straight and the die can be pushed squarely back into the bed of the press. This helps eliminate any hand working that the die setters may have to do once the die is on the press bed to get the die level.

Two box assemblies 32 instead of one are provided for several reasons. First of all, two box assemblies 32 offer a great deal more stability than would one in supporting a die 16. Second, greater pulling power is obtained because there are two motors rather than one to push and pull the die. A further advantage of two die puller assemblies 32 is that fewer sizes of die puller assembly boxes are required. It is necessary, of course, to build die puller assembly boxes 32 of different lengths to accommodate dies of different lengths. However, it is possible to accommodate dies of different widths simply by setting the two die puller box assemblies 32 either closer together or farther apart as required. On the other hand, if a single die puller assembly unit were provided, it would be necessary to provide a number of different sizes, reflecting both the different lengths and the different widths of dies to be pulled. The length of the die puller assemblies 32 are also determined by the distance between presses 10.

The apparatus shown in FIG. 1 has only a single press 10, which is served by a pair of die puller box assemblies 32. One can provide two presses 10, one at each end of the die puller assemblies 32, if desired. It will be appreciated that die puller assemblies 32 are inherently bidirectional, i.e. they are capable of loading and unloading a die in either direction.

It is highly desirable to get the die puller assemblies 32 out of the way when they are not actually in use. Most of the time, die 16 is being used to stamp parts—for example, in automobile sub-assemblies such as a side frame, a hood, etc., if the plant is an auto stamping plant. It is desirable to place some means for receiving the parts, for example a conveyor on wheels, as close as possible to the press 10. Much more efficient use of space can be made if the die puller assemblies 32 are out of the way while the die 16 is actually in use.

While the drawings and specification herein illustrate one means for getting the die puller assemblies 32 out of the way, i.e. by lowering them to a level below the factory floor (i.e. inside shrouds 34), it will be apparent that other ways can be used. For example, one could pivot the die puller assemblies 32 in and out of position. In a third arrangement, the die puller assemblies 32 may be mounted on horizontal pivot pins which are adjacent to press 10, so that the die puller assembly may be raised to a vertical position when not in use. Thus, various arrangements are possible, and in each case the die puller assemblies 32 are movable from a first or operative position in which they are parallel and in position for transfer of a die 16 between the die puller assemblies 32 and press 10, to a second or inoperative position in which die puller assemblies are out of position for transfer of a die between the die puller assemblies and press 10.

The operation of the apparatus of the present invention will now be described.

Normally the die puller box assemblies 32 are in the second or "down" position, concealed in shrouds 34. When it is necessary to change dies, the sequence of operation is as follows:

First, the die puller box assemblies 32 are lifted to the "up" or first position, i.e. as shown in the drawings by means of jack screws 40. Second, the die puller box assemblies 32 are clamped (by means of clamps not shown) to the press bed 12 or the bolster 14. Third, a shackle or a chain is attached from the die 16 (i.e. via hook or eyelet 18) to the die puller ram hook 22, as shown in FIG. 2 of the drawing. Then, by operation of hydraulic motors 58, ends 72 and ram hooks 22 fixedly mounted thereon are caused to reciprocate away from the press 10. This pulls the dies 16 from the press onto the die puller assemblies 32. There will be appreciated that the die 16 rides on the wear plates 88, which of course causes wear in time. For this reason replacable wear plates 88 are provided. Finally, the die 16 is removed from the die puller assembly boxes 32 by means of an overhead crane (not shown).

A new die is put in place by a sequence of steps which is essentially the reverse of the above. First, the new die is placed on die puller assemblies 32 by means of an overhead crane. Next, the die is pushed into place by the forward end of ram hook 22. Ram hook 22 may have a flattened forward end to facilitate pushing. Next, the die puller box assemblies 32 are unclamped from the bolster 14 or press bed 12 and the hook 22 is removed from the ram 72. Removal of hook 22 is necessary because of the limited space in shroud 34. Finally, the die puller boxes 32 are lowered into shrouds 34 by means of the jack screws 40.

A major advantage of the apparatus of the present invention is that it permits much faster changing of dies than is possible with any presently known apparatus. A second advantage of the apparatus of this invention is that it is rugged. A third advantage is that it is simple in design and easy to repair and to replace worn parts. Normal replacement of wear parts, such as gibs 86 and wear plates 88 can be carried out by semi-skilled maintanence personnel employed by the machine owner, without the necessity of a skilled repairman from the manufacturer to make the repairs. Another advantage is that the apparatus of the present invention, by virtue of the openings between plates 50, collects little debris and is therefore easy to keep clean and in good operating order. Thus, it is possible to change speed and/or torque without any change in the assemblies 32, up to the maximum capabilities of the hydraulic motors 48 and 58. By installing high torque hydraulic motors in the first place, one can use the apparatus herein for virtually any die pulling service. A further advantage is that the present apparatus is easy to lubricate. Both the wear plates 88 and the gibs 86 are readily accessible for lubrication.

While in accordance with the patent statutes, a preferred embodiment and best mode has been presented, the scope of the invention is not limited thereto, but rather is measured by the scope of the attached claims.

What is claimed is:

1. Apparatus for changing a die, which is supported on a stationary die supporting member when in use, said apparatus comprising:

(a) die puller means located alongside said stationary die supporting member, said die puller means having a first position in which it is operatively positioned for transfer of a die to or from said stationary die supporting member and a second position in which it is inoperative, said die puller means and said stationary die supporting member having die supporting surfaces which are substantially flush when said die puller means is in its first position;

(b) means associated with said die puller means for moving a die horizontally from said die puller means to said stationary die supporting member or vice versa when said die puller means is in its first position and (c) means for moving said die puller means between said first position and said second position.

2. Apparatus according to claim 1 in which said die puller means comprises a pair of parallel die puller box assemblies.

3. Apparatus according to claim 1 in which said second position is below said first position, and said means for moving said die puller means comprises means for lifting said die puller means from said second position to said first position.

4. Apparatus according to claim 1 in which said means for moving said die puller means from said first position to said second position comprise a first hydraulic motor, and in which said means for moving said die horizontally comprises a second hydraulic motor.

5. Apparatus according to claim 2, in which each die puller box assembly includes a first hydraulic motor for moving said die puller box assembly from said first position to said second position, and a second hydraulic motor for moving said die horizontally, the hydraulic motors asociated with each die puller box assembly being controlled independently from the hydraulic motor associated with the other die puller box assembly.

6. Apparatus for changing a die comprising:

(a) stationary means for supporting a die when said die is in use;

(b) die puller means located alongside said stationary member, one end of said die puller means being located adjacent to said stationary member, said die puller means having a first position in which it is operatively positioned for transfer of a die to or from said stationary means and a second position in which it is inoperative, said die puller means and said stationary means having die supporting surfaces which are substantially flush when said die puller means is in its first position;

(c) means associated with said die puller means for moving a die horizontally from said die puller means to said stationary member or vice versa when said die puller means is in its first position, and (d) means for lifting said die puller means from a first postion to a second position, the top surface of said die puller means being flush with the die supporting surface of said stationary means when said die puller means is in its first position.

7. Apparatus according to claim 6 in which said die puller means comprises a pair of parallel die puller box assemblies.

8. Apparatus according to claim 7 in which said die puller box assemblies are controllable independently of each other.

9. Apparatus according to claim 6 in which said stationary means is a press.

10. Apparatus according to claim 5 in which said second position is below said first position.

11. Apparatus according to claim 1 in which said stationary die supporting member is a press.

* * * * *